US008011809B2

(12) United States Patent
Liao

(10) Patent No.: US 8,011,809 B2
(45) Date of Patent: Sep. 6, 2011

(54) LIGHT-EMITTING DIODE MODULE WITH HEAT DISSIPATING STRUCTURE AND LAMP WITH LIGHT-EMITTING DIODE MODULE

(76) Inventor: Yun Chang Liao, Renwu Township, Kaohsiung County (TW)

( * ) Notice: Subject to any disclaimer, the term of this patent is extended or adjusted under 35 U.S.C. 154(b) by 262 days.

(21) Appl. No.: 12/466,427

(22) Filed: May 15, 2009

(65) Prior Publication Data

US 2009/0284972 A1 Nov. 19, 2009

Related U.S. Application Data

(63) Continuation-in-part of application No. 12/190,637, filed on Aug. 13, 2008, now Pat. No. 7,837,358.

(30) Foreign Application Priority Data

May 16, 2008 (TW) ..... 97118242 A
Feb. 19, 2009 (TW) ..... 98202426 U

(51) Int. Cl.
*F21V 29/00* (2006.01)

(52) U.S. Cl. ..... 362/294; 362/249.02; 362/264

(58) Field of Classification Search ..... 362/218, 362/240, 247, 249.01, 249.02, 249.06, 249.14, 362/255, 264, 294, 345, 373, 507, 545, 547, 362/800; 257/98–100, 722; 361/707
See application file for complete search history.

(56) References Cited

U.S. PATENT DOCUMENTS

| | | | | |
|---|---|---|---|---|
| 4,204,246 | A | 5/1980 | Arii et al. | |
| 7,048,412 | B2 | 5/2006 | Martin et al. | 362/247 |
| 7,210,832 | B2 | 5/2007 | Huang | 362/547 |
| 7,314,291 | B2 | 1/2008 | Tain et al. | 362/294 |
| 7,331,691 | B2 | 2/2008 | Livesay et al. | 362/294 |
| 7,413,326 | B2 | 8/2008 | Tain et al. | 362/294 |
| 7,434,964 | B1 | 10/2008 | Zheng et al. | 362/294 |
| 7,543,960 | B2 | 6/2009 | Chang et al. | 362/294 |
| 7,568,817 | B2 | 8/2009 | Lee et al. | 362/294 |
| 7,572,033 | B2 | 8/2009 | Sun et al. | 362/294 |
| 7,581,856 | B2 | 9/2009 | Kang et al. | 362/373 |
| 7,635,205 | B2 | 12/2009 | Yu et al. | 362/294 |
| 2004/0213016 | A1 | 10/2004 | Rice | 362/547 |
| 2005/0024875 | A1 | 2/2005 | Zhang | 362/264 |
| 2008/0130299 | A1 | 6/2008 | Dorogi | 362/373 |

*Primary Examiner* — Hargobind S Sawhney

(74) *Attorney, Agent, or Firm* — Alan Kamrath; Kamrath & Associates PA

(57) ABSTRACT

A lamp (6) includes a housing (5) mounted to a lamp post (4) and a light-emitting diode module (10) mounted in the housing (5). The light-emitting diode module (10) includes a metal substrate (21) and a plurality of light-emitting diode dies (221) mounted on a face (211) of the metal substrate (21). A jacket (11) has a coupling surface (112) engaged with the other face (212) of the metal substrate (21). A heat conduction pipe (12) includes a portion (123) received in a longitudinal hole (111) of the jacket (11). The coupling surface (112) of the jacket (11) has an opening (114) in communication with the longitudinal hole (111). A portion of an outer periphery (124) of the portion (123) of the heat conduction pipe (12) is in direct, thermal contact with the other face (212) of the metal substrate (21) through the opening (114) of the jacket (11) to absorb heat generated by the light-emitting diode dies (221). A finned heat sink (13) is mounted on another portion (121) of the heat conduction pipe (12) outside the jacket (11) to dissipate heat transferred to the heat conduction pipe (12) into the environment.

14 Claims, 21 Drawing Sheets

LIGHT-EMITTING DIODE MODULE WITH HEAT DISSIPATING STRUCTURE AND LAMP WITH LIGHT-EMITTING DIODE MODULE

CROSS REFERENCE TO RELATED APPLICATION

This is a continuation-in-part application of U.S. patent application Ser. No. 12/190,637 filed Aug. 13, 2008 now U.S. Pat. No. 7,837,358.

BACKGROUND OF THE INVENTION

The present invention relates to a light-emitting diode module with a heat dissipating structure. The present invention also relates to a lamp with such a light-emitting diode module.

Light-emitting diode modules including packaged light-emitting diodes (LEDs) are widely used as light sources in a variety of lamps, signs and image displays. LED dies generate heat during operation, which heat must be removed to keep high illumination efficiency. To this end, heat dissipating devices are provided to dissipate heat generated inside the light sources to the surrounding environment. Conventional heat dissipating devices for LED light sources generally include a heat sink connected to a circuit board or a substrate on which LEDs are disposed. However, directly assembling of the heat sink to the circuit board or substrate is not easy and could damage the LEDs during assembly.

U.S. Pat. No. 4,204,246 disclosed a cooling assembly including a heat-generating electric part, a heat conductive block mounting the heat-generating electric part, and a heat pipe attached to the heat conductive block for radiating the heat from the heat-generating electric part to the air through the heat conductive block. Plural cooling fins are fixed on a condensing portion of the heat pipe to obtain a higher radiation effect. However, the assembly of the heat-generating electric part and the heat conductive block is complicated. Further, the heat pipe is not in direct, thermal contact with the heat generating electric part, resulting in unsatisfactory heat dissipation effect.

Thus, a need exists for a light-emitting diode module with a heat dissipating structure that allows easy assembly while having improved heat dissipation efficiency.

BRIEF SUMMARY OF THE INVENTION

The present invention solves this need and other problems in the field of heat dissipation for LEDs by providing, in a preferred form, a light-emitting diode module including a metal substrate having opposite first and second faces. A plurality of light-emitting diode dies is mounted to the first face of the metal substrate and in direct, thermal contact with the metal substrate. A jacket includes a coupling surface engaged with the second face of the metal substrate. The jacket further includes a longitudinal hole having a longitudinal axis. The coupling surface of the jacket has an opening extending in a direction parallel to the longitudinal axis and in communication with the longitudinal hole. A heat conduction pipe includes a first portion received in the longitudinal hole of the jacket and a second portion outside the jacket. The first portion of the heat conduction pipe has an outer periphery. A portion of the outer periphery of the first portion of the heat conduction pipe is in direct, thermal contact with the second face of the metal substrate through the opening of the jacket to absorb heat generated by the plurality of light-emitting diode dies. A finned heat sink is mounted on the second portion of the heat conduction pipe and includes a plurality of fins to dissipate heat transferred to the heat conduction pipe into an environment outside the finned heat sink.

In a preferred form, the jacket is a thermally conductive metal block. The longitudinal hole is circular in cross section, and the opening extends in a plane tangent to the longitudinal hole.

In another preferred form, the jacket is a thermally conductive metal tube having C-shaped cross sections such that the first portion of the heat conduction pipe can be clamped in the longitudinal hole. The metal tube has two parallel, spaced, longitudinal edges each extending in the direction parallel to the longitudinal axis, and the opening is defined between the two longitudinal edges. Two longitudinal bends project outwardly away from each other and from the two longitudinal edges and extend in a plane parallel to the opening. Each longitudinal bend includes a surface facing the second face of the metal substrate and forming the coupling surface.

In accordance with another aspect of the present invention, a lamp is provided and includes a housing adapted to be mounted to a lamp post. A metal substrate is mounted in the housing and has opposite first and second faces. A plurality of light-emitting diode dies is mounted to the first face of the metal substrate and in direct, thermal contact with the metal substrate. A jacket includes a coupling surface engaged with the second face of the metal substrate. The jacket further includes a plurality of longitudinal holes parallel to and spaced from one another and each having a longitudinal axis. A spacing ranging from 0 to 0.5 mm is defined between an inner periphery of each longitudinal hole and the coupling surface. A plurality of heat conduction pipes each includes a first portion received in one of the longitudinal holes of the jacket and a second portion outside the jacket. A finned heat sink is mounted on the second portions of the heat conduction pipes and includes a plurality of fins to dissipate heat transferred to the heat conduction pipes into an environment outside the finned heat sink.

In a preferred form, the coupling surface of the jacket has a plurality of openings each extending in a plane tangent to and in communication with one of the longitudinal holes. The first portion of each heat conduction pipe has an outer periphery. A portion of the outer periphery of the first portion of each heat conduction pipe is in direct, thermal contact with the second face of the metal substrate through one of the openings of the jacket to absorb heat generated by the light-emitting diode dies.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
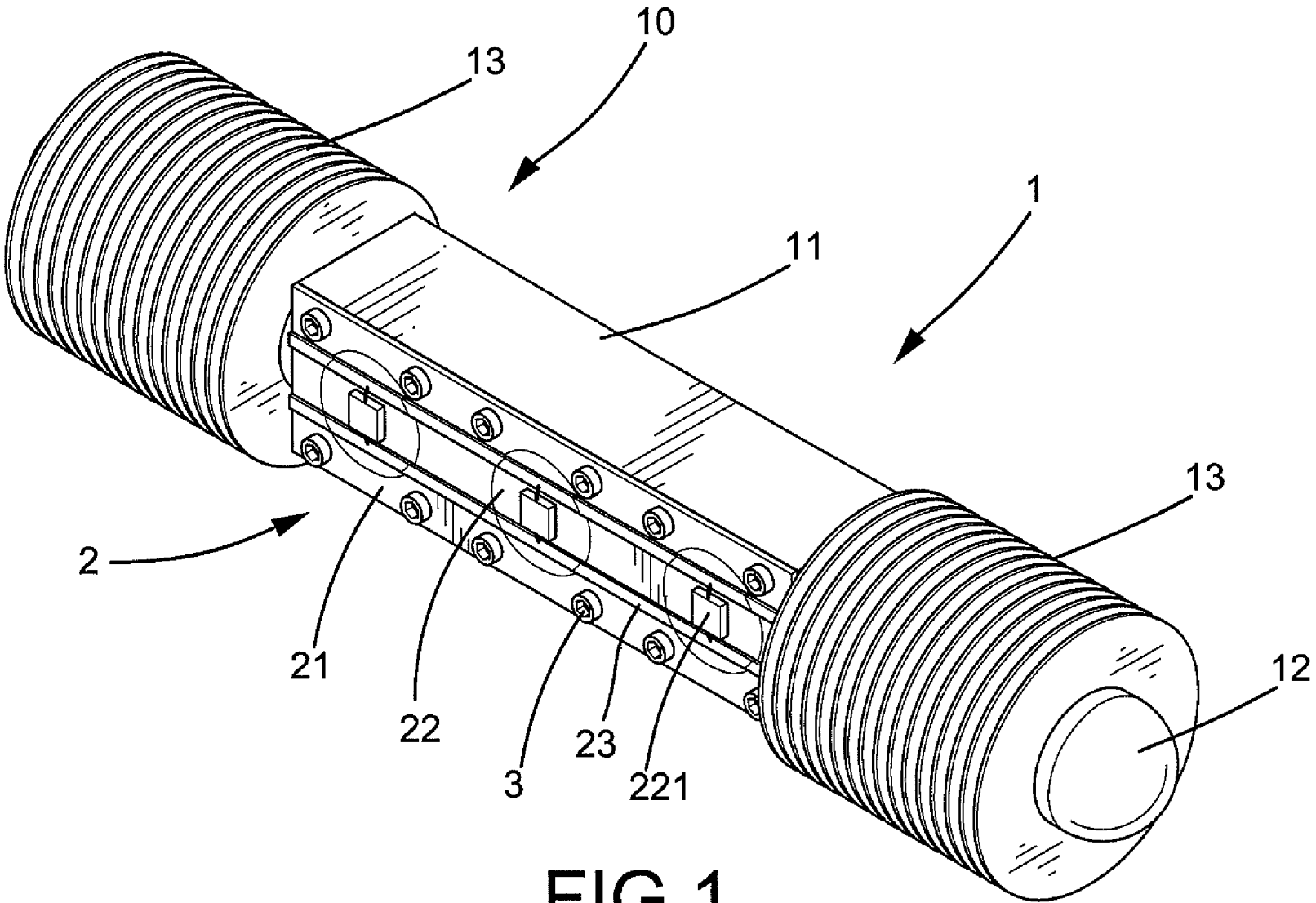
FIG. 1 shows a perspective view of a light-emitting diode module of a first embodiment according to the preferred teachings of the present invention.
Figure 2:
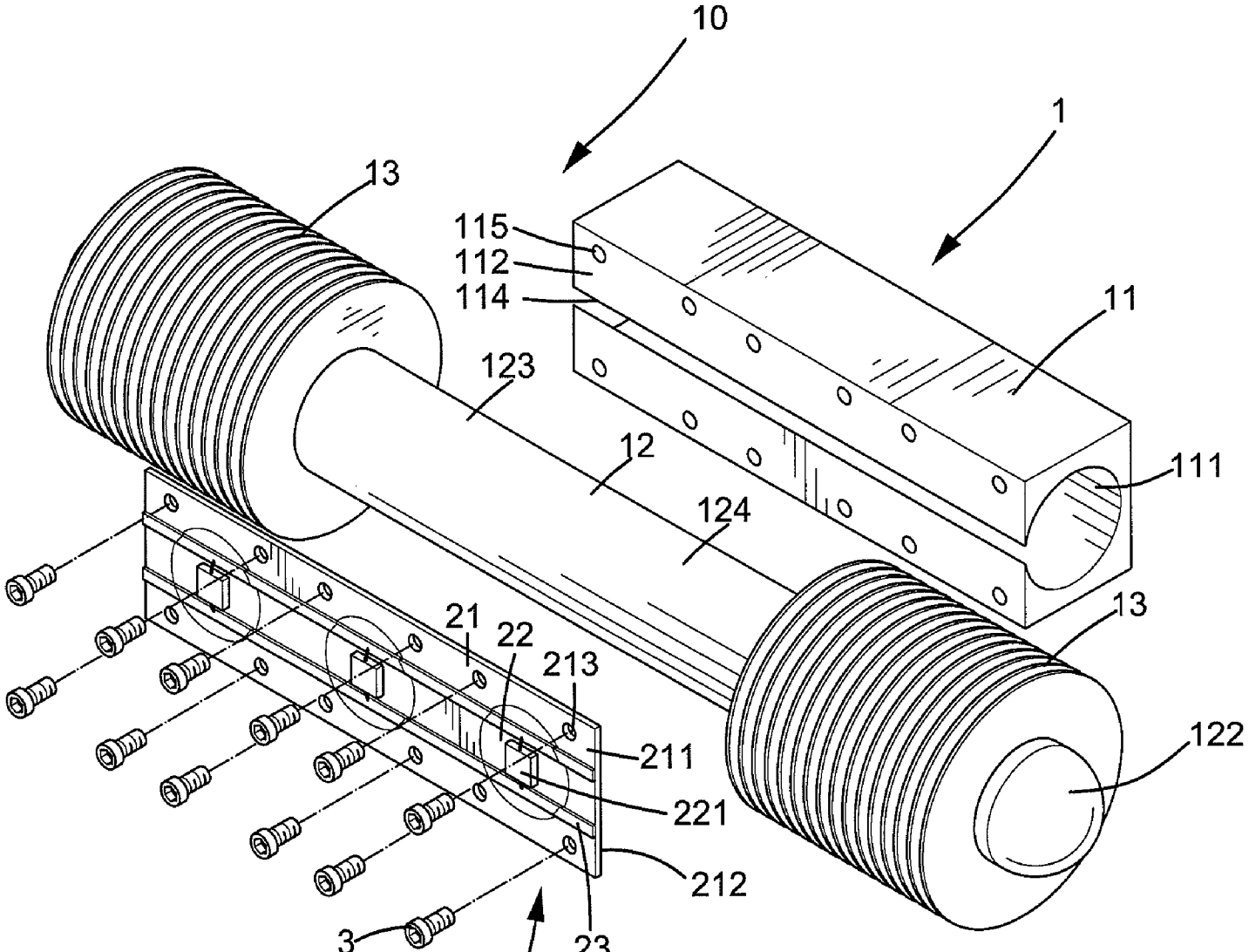
FIG. 2 shows an exploded, perspective view of the light-emitting diode module of FIG. 1.
Figure 3:
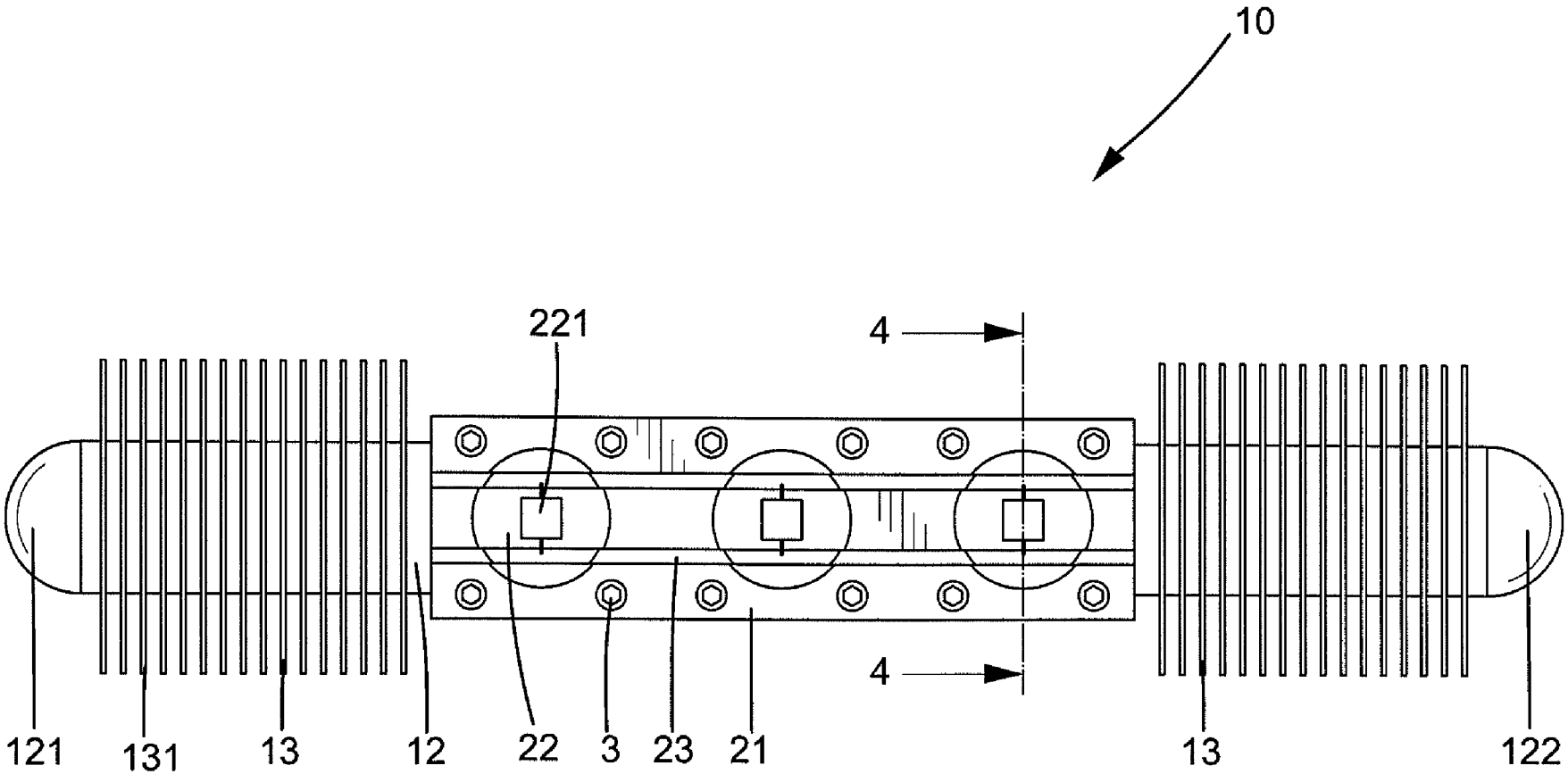
FIG. 3 shows a side view of the light-emitting diode module of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "spacing", "longitudinal", "lateral", "transverse", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A light-emitting diode module with a heat dissipating structure of an embodiment according to the preferred teachings of the present invention is shown in FIGS. 1-4 of the drawings and generally designated 10. According to the preferred form shown, light-emitting diode module 10 includes a light-emitting diode (LED) light source assembly 2 including a metal substrate 21 having a first face 211 and a second face 212 opposite to first face 211, a circuit board 23 mounted on first face 211, and a plurality of light-emitting diodes 22 mounted to first face 211 as a light source. Each light-emitting diode 22 includes at least one LED die 221 electrically connected to circuit board 23 and in direct, thermal contact with metal substrate 21. Metal substrate 21 has a thickness ranging from 0.5 to 1 mm and a plurality of through-holes 213 extending from first face 211 through second face 212.

Figure 4:
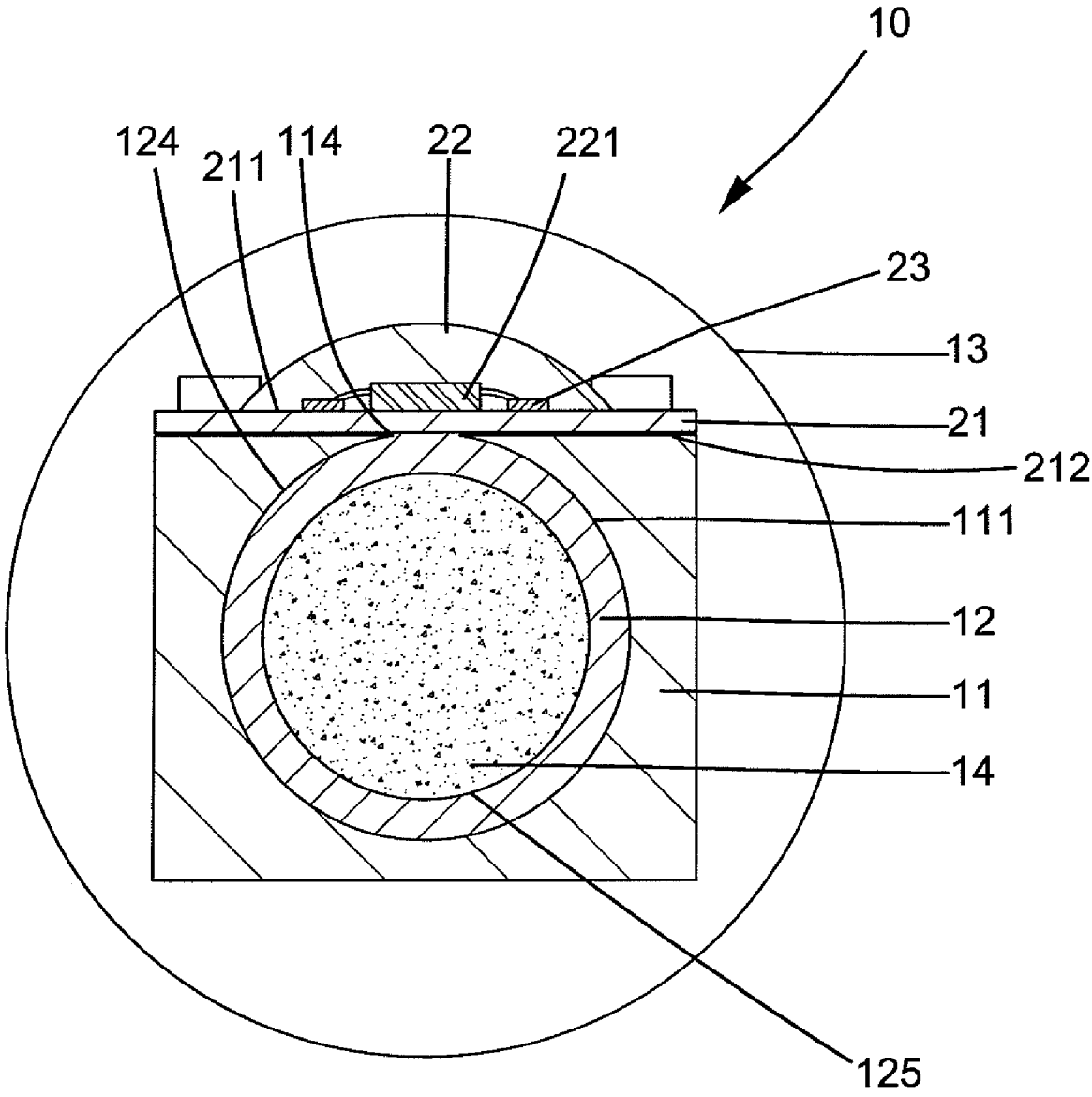
FIG. 4 is a cross sectional view taken along section line 4-4 of FIG. 3.
Figure 5:
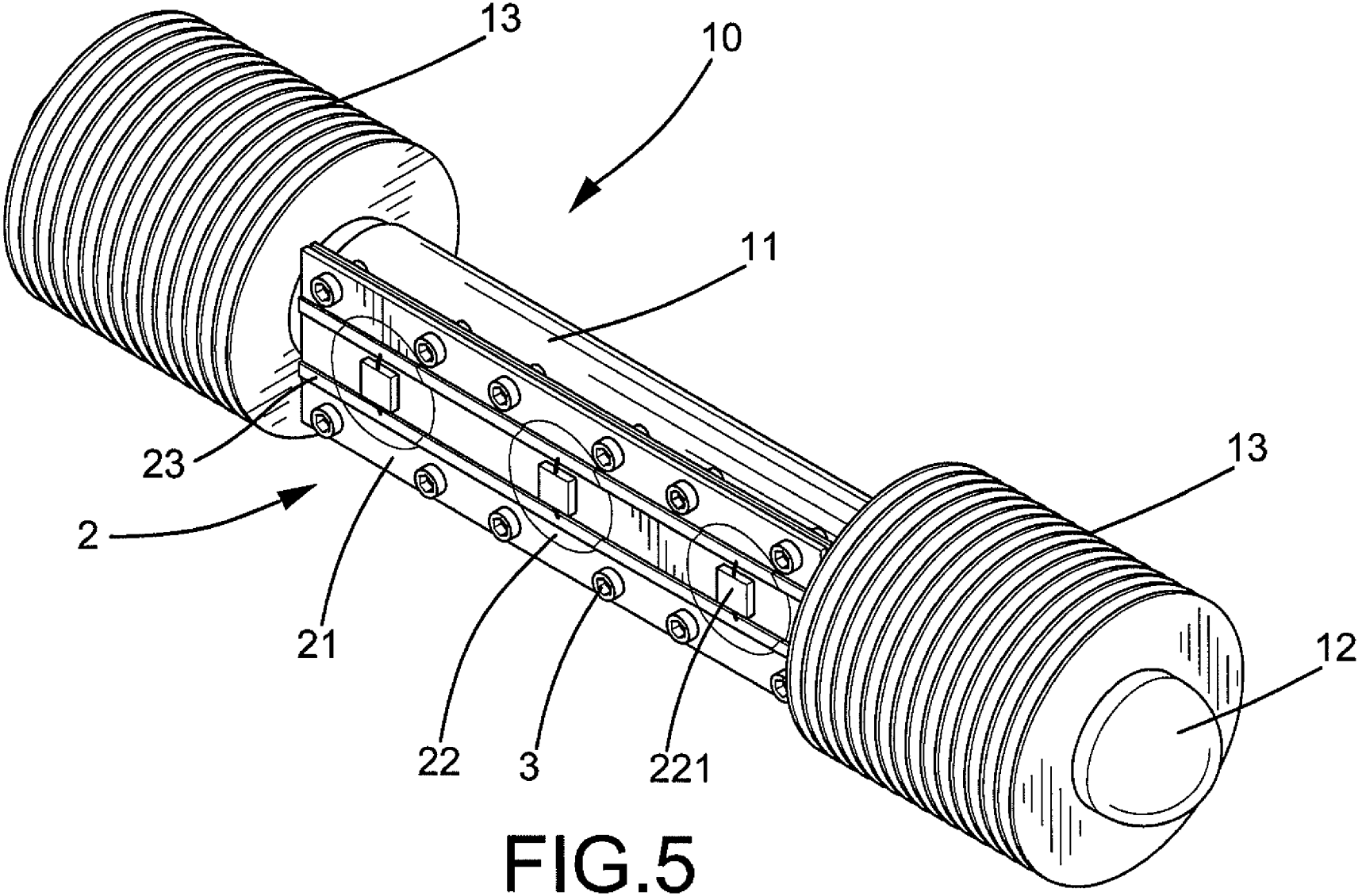
FIG. 5 shows a perspective view of a light-emitting diode module of a second embodiment according to the preferred teachings of the present invention.
Figure 6:
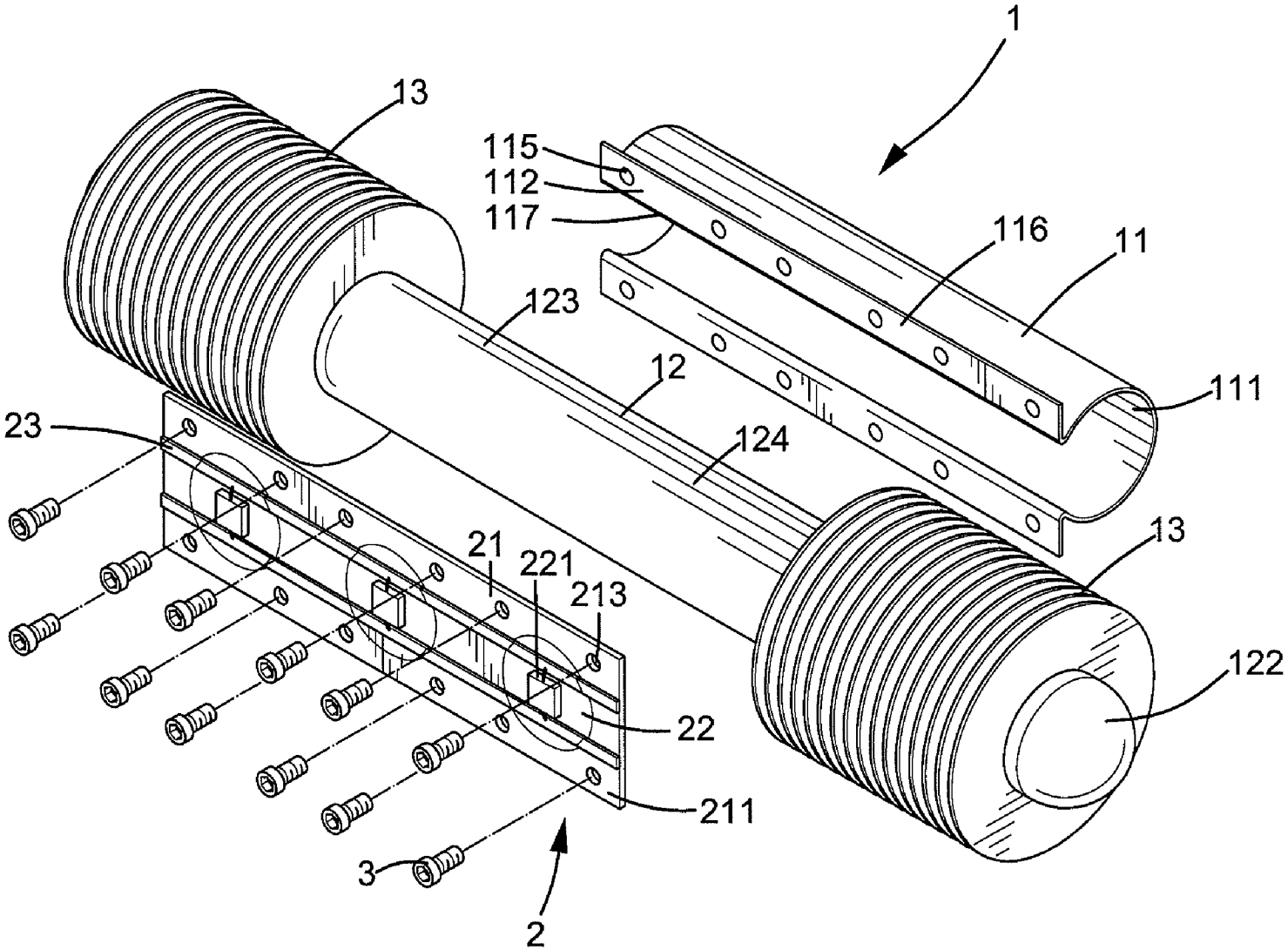
FIG. 6 shows an exploded, perspective view of the light-emitting diode module of FIG. 5.
Figure 7:
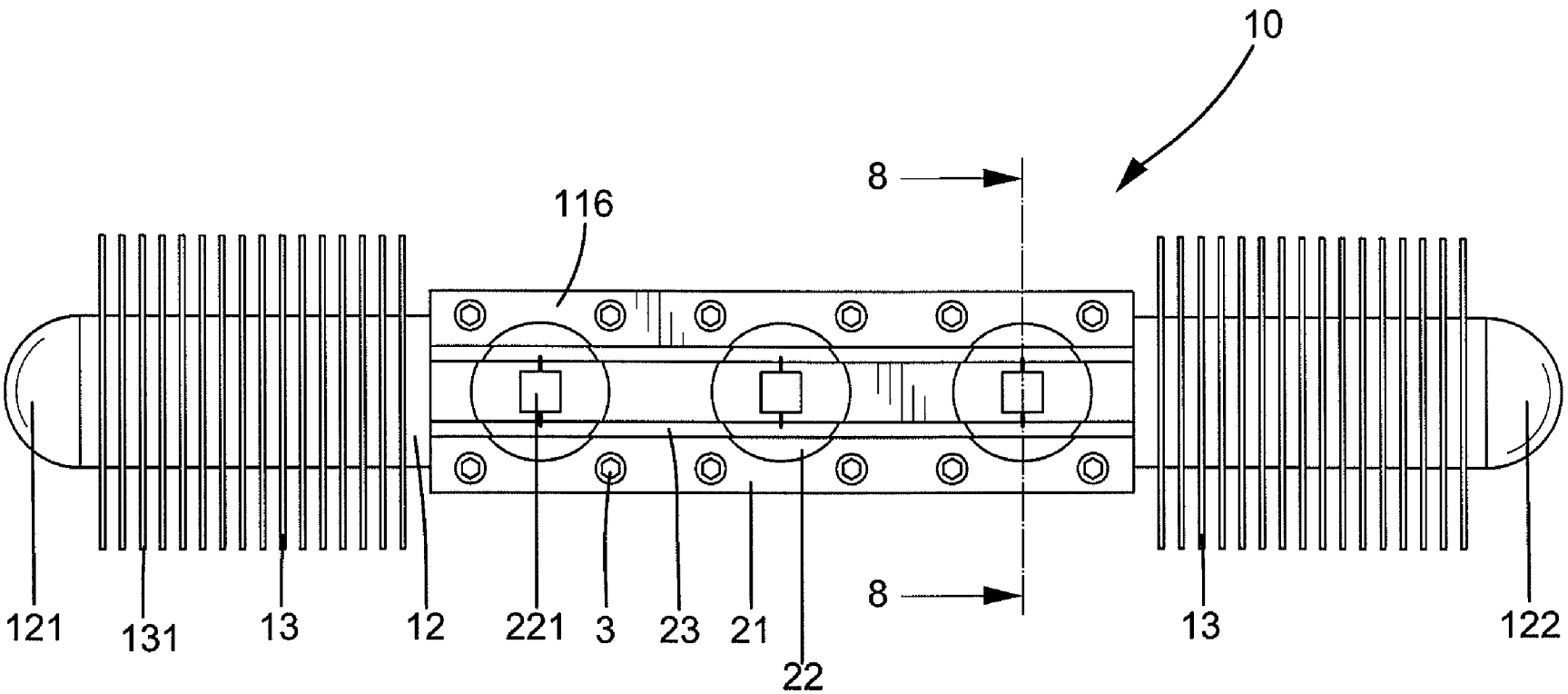
FIG. 7 shows a side view of the light-emitting diode module of FIG. 5.
Figure 8:
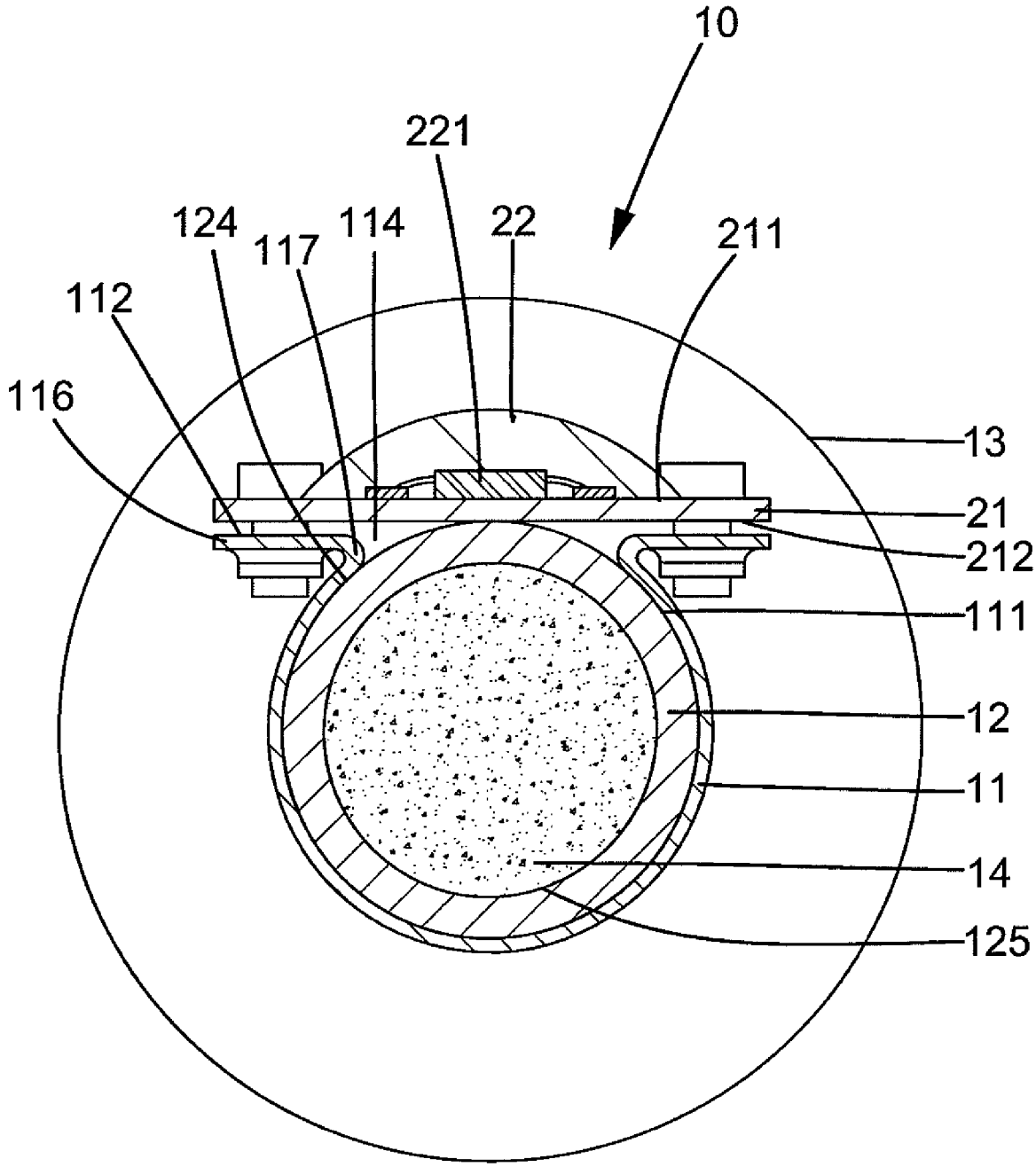
FIG. 8 is a cross sectional view taken along section line 8-8 of FIG. 7.

In the preferred form shown in FIGS. 1-4, light-emitting diode module 10 further includes a heat dissipating module 1 including a jacket 11, a heat conduction pipe 12, and two finned heat sinks 13. Jacket 11 is made of a thermally conductive metal, such as an aluminum or copper block. Jacket 11 includes a longitudinal hole 111 having a longitudinal axis. Jacket 11 further includes a coupling surface 112 engaged with second face 212 of metal substrate 21. Coupling surface 112 includes a plurality of engaging holes 115, and a plurality of fasteners 3 are respectively extended through through-holes 213 of metal substrate 21 and into engaging holes 115 of jacket 11 to engage metal substrate 21 with jacket 11. Coupling surface 112 of jacket 11 has an opening 114 extending in a direction parallel to the longitudinal axis of longitudinal hole 111 and in communication with longitudinal hole 111. Longitudinal hole 111 is circular in cross section, and opening 114 extends in a plane tangent to longitudinal hole 111. Heat conduction pipe 12 includes a first portion 123 received in longitudinal hole 111 of jacket 11, a second portion 121 outside jacket 11, and a third portion 122 outside jacket 11. First portion 123 of heat conduction pipe 12 is intermediate between second portion 121 and third portion 122. A portion of an outer periphery 124 of first portion 123 of heat conduction pipe 12 is in direct, thermal contact with second face 212 of metal substrate 21 through opening 114 of jacket 11 to absorb heat generated by light-emitting diode dies 221 (FIG. 4). Heat conduction pipe 12 includes annular cross sections and defines a chamber 125 in which heat transfer medium 14 such as superconducting material is received. Finned heat sinks 13 are respectively mounted on second and third portions 122 and 123 of heat conduction pipe 12. Each finned heat sink 13 includes a plurality of fins 131 to dissipate heat transferred to heat conduction pipe 12 into the environment outside finned heat sinks 13.

Heat dissipating module 1 is engaged with metal substrate 21 of LED light source assembly 2 via coupling surface 112 of jacket 11 to allow easy assembly and to prevent damage to LEDs 22. Further, a more effective thermal conduction path is provided by direct, thermal contact between heat conduction pipe 12 and metal substrate 21 of LED light source assembly 2. Increased heat dissipating efficiency is, thus, provided to LEDs 22.

FIGS. 5 through 8 show an alternate embodiment of jacket 11 of light-emitting diode module 10 according to the present invention. Jacket 11 is a thermally conductive metal tube including C-shaped cross sections such that first portion 123 of heat conduction pipe 12 can be clamped in longitudinal hole 111 of jacket 11 to facilitate engagement between heat conduction pipe 12 and jacket 11. Jacket 11 has two parallel, spaced, longitudinal edges 117 each extending in the direction parallel to the longitudinal axis of longitudinal hole 111, and an opening 114 is defined between longitudinal edges 117. Two longitudinal bends 116 project outwardly away from each other and from longitudinal edges 117 and extend in a plane parallel to opening 114. Each longitudinal bend 116 includes a surface facing second face 212 of metal substrate 21. The surfaces of longitudinal bends 116 form coupling surface 112. Each longitudinal bend 116 further includes a plurality of engaging holes 115, and a plurality of fasteners 3 is respectively extended through through-holes 213 of metal substrate 21 and into engaging holes 115 of metal tube 11 to securely engage metal substrate 21 with jacket 11.

Figure 9:
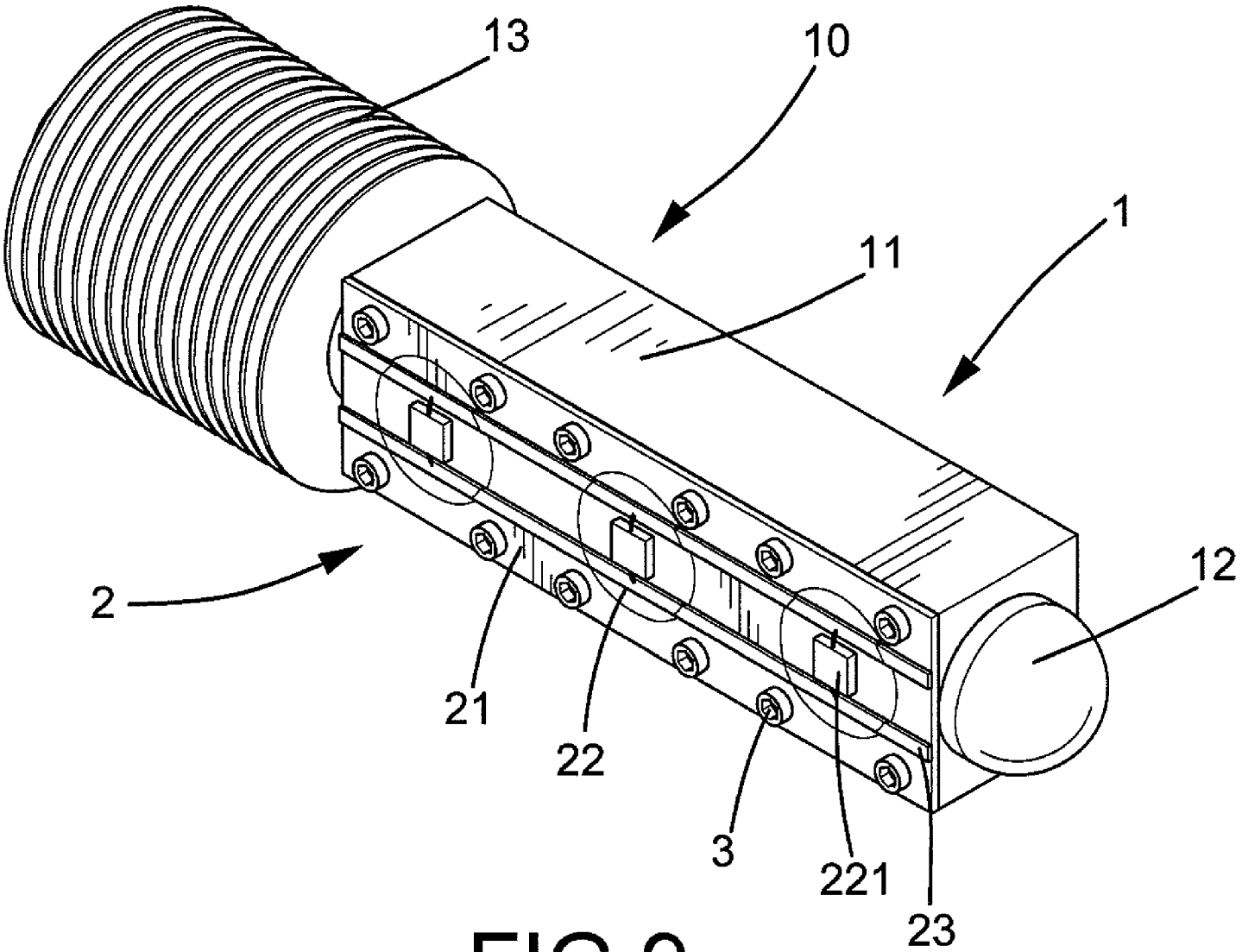
FIG. 9 shows a perspective view of a light-emitting diode module of a third embodiment according to the preferred teachings of the present invention.
Figure 10:
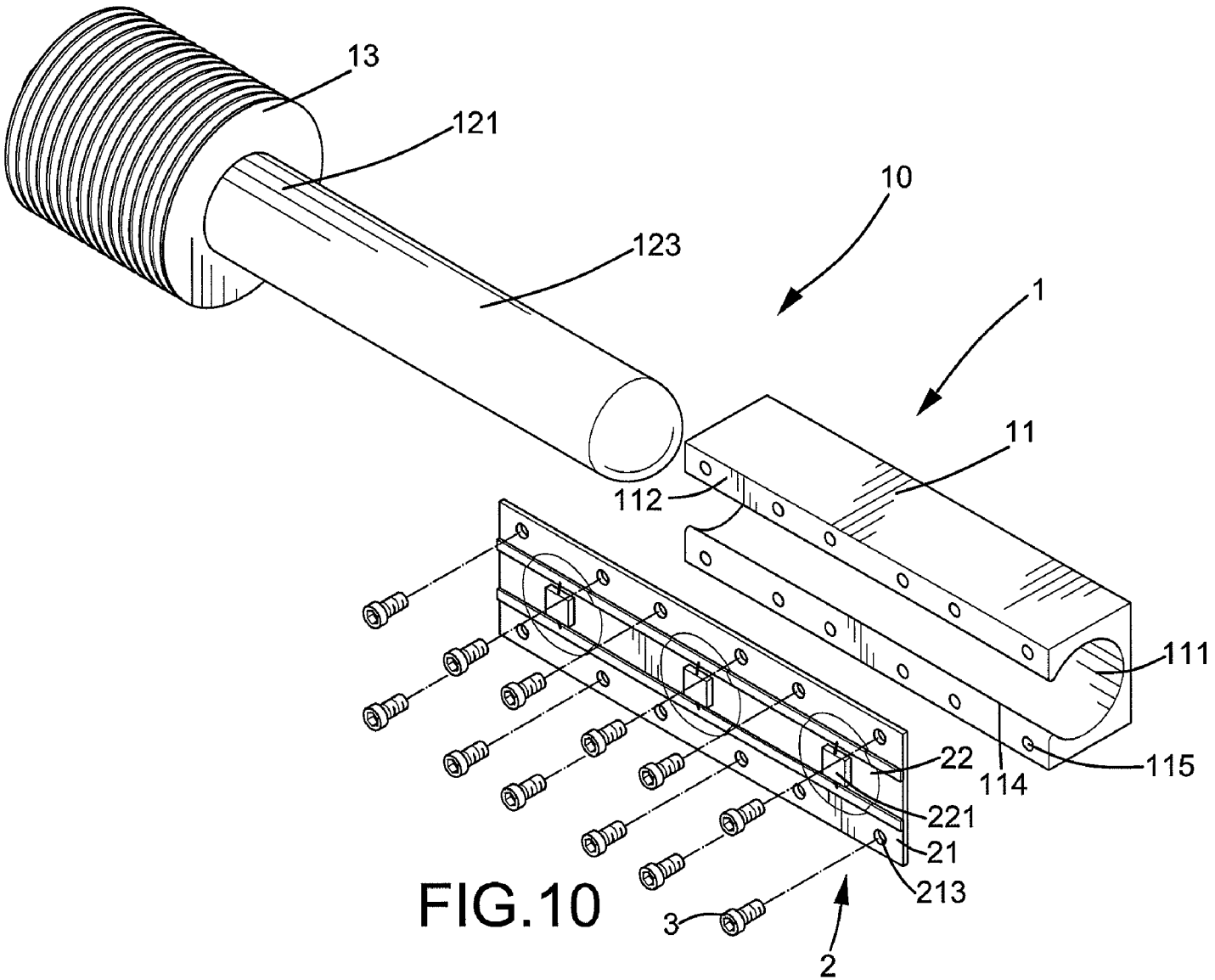
FIG. 10 shows an exploded, perspective view of the light-emitting diode module of FIG. 9.
Figure 11:
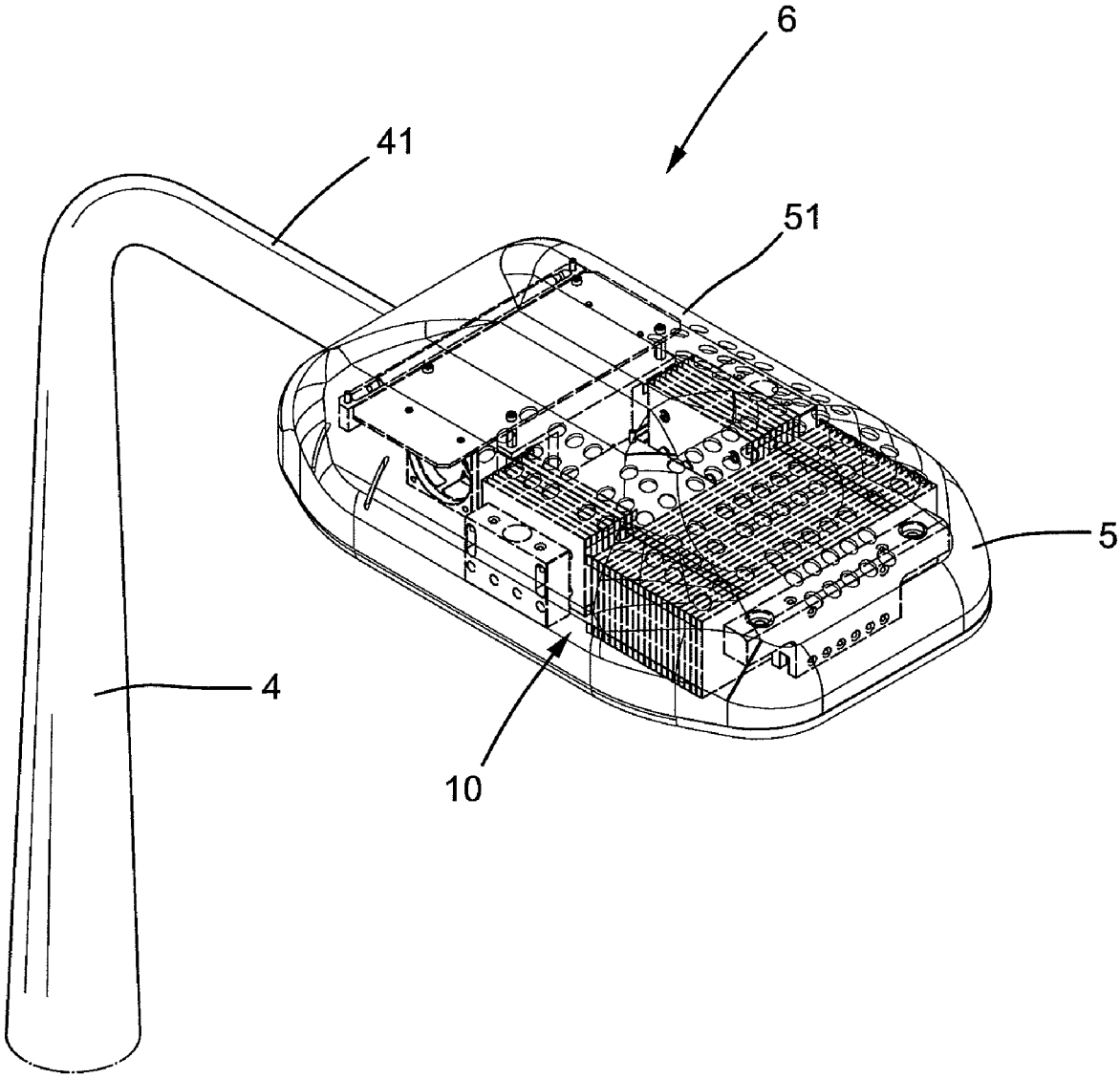
FIG. 11 shows a perspective view illustrating use of a light-emitting diode module of another embodiment according to the present invention in a lamp mounted to a lamp post.
Figure 12:
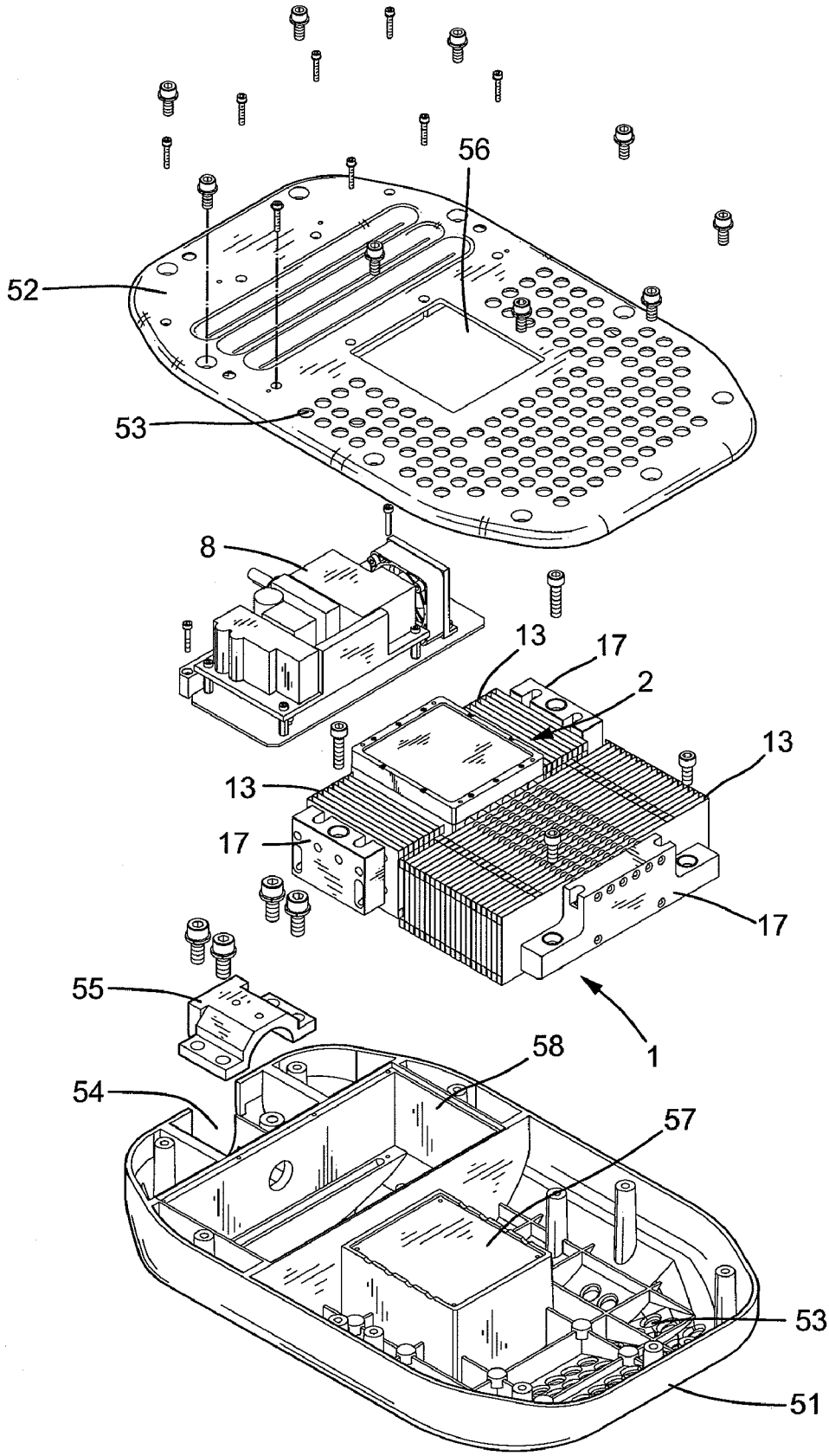
FIG. 12 shows an exploded, perspective view of the lamp of FIG. 11.

FIGS. 9 and 10 show a modification of heat conduction pipe 12 of light-emitting diode module 10 according to the present invention. In this modified embodiment, third portion 122 and finned heat sink 13 mounted on third portion 122 are omitted. By such an arrangement, the length of heat conduction pipe 12 can be shortened and the volume of the light-emitting diode module 10 reduced.

FIGS. 11 through 17 show another embodiment of light-emitting diode module 10 according to the present invention and illustrate use of light-emitting diode module 10 in a light-emitting diode lamp. In this example, light-emitting diode lamp is used as a road lamp 6 for illumination at night.

Lamp 6 includes a housing 5, light-emitting diode (LED) light source assembly 2 and heat dissipating module 1, wherein components in this embodiment identical or similar to those in FIGS. 1 through 4 are designated with the same reference numbers. Housing 5 includes a first cover 51 and a second cover 52 secured to first cover 51. First cover 51 includes a semi-circular hole 54 in an end thereof, and an arcuate mounting plate 55 is secured to an interior wall of first cover 51 and opposite to hole 54. First cover 51 and mounting plate 55 together form a circular hole into which an upper end 41 of a lamp post 4 is extended for mounting housing 5 to lamp post 4. A plurality of perforations 53 is provided in first and second covers 51 and 52 for ventilation, and an opening 56 is provided in second cover 52 for transmitting light. First cover 51 further includes a compartment 57 for receiving a coolant for cooling purposes and a recessed portion 58 receiving a power supply 8.

In the preferred form shown in FIGS. 11-17, LED light source assembly 2 includes a plurality of metal substrates 21 joined together, a plurality of circuit boards 23 each mounted on first face 211 of one of metal substrates 21, and a plurality of light-emitting diodes 22 mounted to first faces 211 of metal substrates 21 as a light source. Each light-emitting diode 22 includes at least one LED die 221 electrically connected to one of circuit boards 23 and in direct, thermal contact with one of metal substrates 21. A glass shade 24 in alignment with opening 56 covers LED light source assembly 2 and is positioned by a frame 25 located in opening 56 and fixed around a periphery of glass shade 24. Light-emitting diodes 22 mounted to first faces 211 of metal substrates 21 are arranged in an array including a plurality of rows of light-emitting diodes 22 parallel to and spaced from one another and each row having a longitudinal axis. A plurality of light-concentrating sticks 26 is disposed on first faces 211 of metal substrates 21 in a direction parallel to the longitudinal axis of light-emitting diodes 22 and each covers an associated row of light-emitting diodes 22. Each light-concentrating stick 26 includes a plurality of cylindrical light-concentrating holes 261 each receiving one of light-emitting diodes 22 (FIG. 16*a*) so that the light emitted by each light-emitting diode 22 is concentrated in one of light-concentrating holes 261, preventing the light from scattering. An opening 262 having an enlarged conic periphery is formed in outer end of each light-concentrating hole 261 to guide the light emitted by light-emitting diode dies 221 and to create an enlarged illumination area.

In the preferred form shown in FIGS. 11-17, LED light source assembly 2 further includes a plurality of light blocking walls 27 disposed on first faces 211 of metal substrates 21 in a direction parallel to the longitudinal axis of light-emitting diodes 22 and each between two rows of light-emitting diodes 22 adjacent to each other. Each light blocking wall 27 is in the form of an elongated body and includes a lower face 271 attached to first faces 211 of metal substrates 21 by screws 28. Each light blocking wall 27 further includes an upper face 273 spaced from lower face 271 in a direction perpendicular to the longitudinal axis of light-emitting diodes 22 and two inclined, opposite, lateral faces 272 each extending between upper face 273 and lower face 271. Each light blocking wall 27 is made of light-reflecting material, and each lateral face 272 is tapered to upper face 273 of light blocking wall 27, so that the light beams emitted by light-emitting diodes 22 are blocked and reflected at the lateral faces 272 of light blocking walls 27, avoiding divergence and interference of the light emitted by each light-emitting diode dies 221. As a result, the illumination efficiency is greatly increased.

Figure 13:
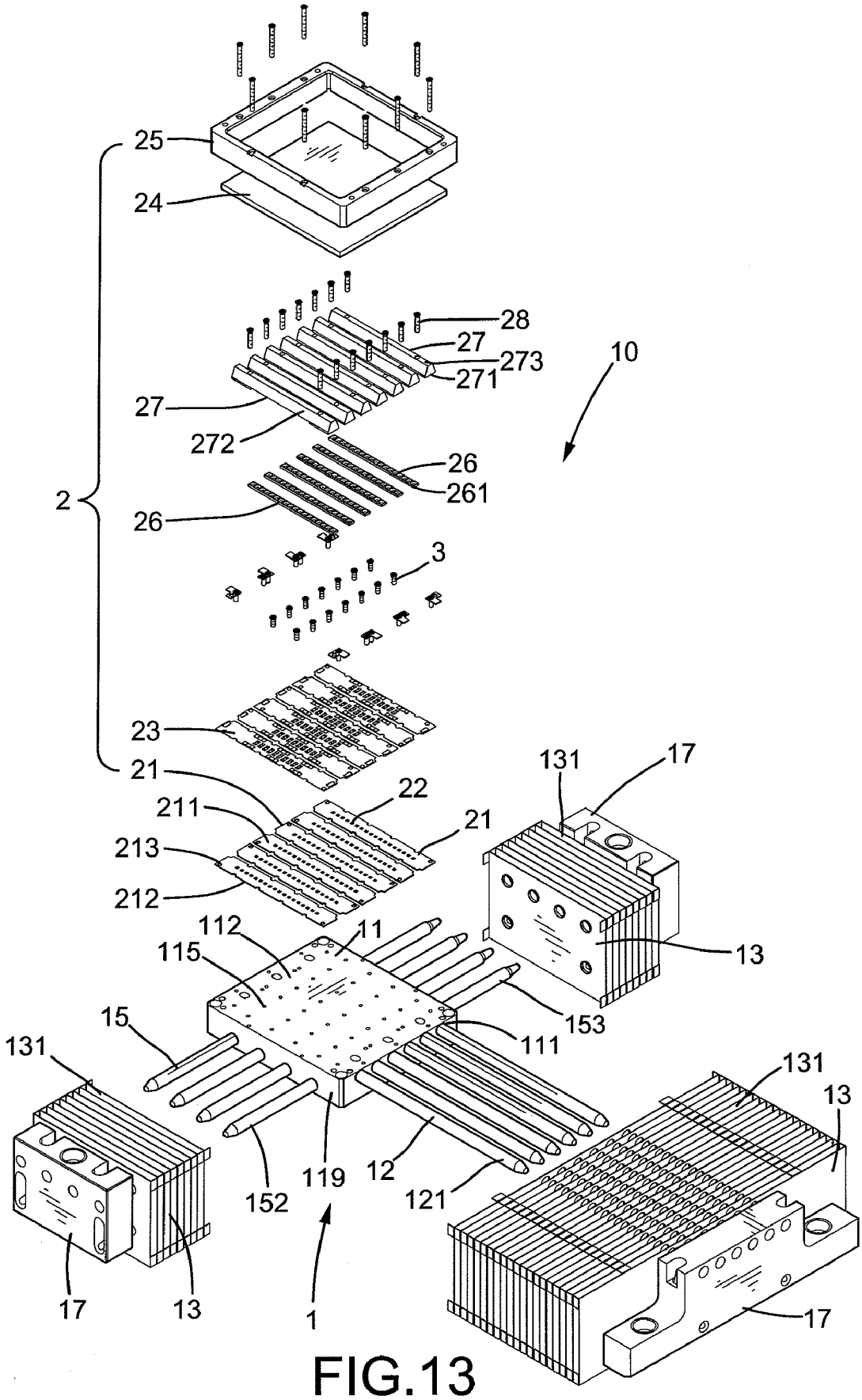
FIG. 13 shows an exploded, perspective view of the light-emitting diode module of FIG. 11.
Figure 14:
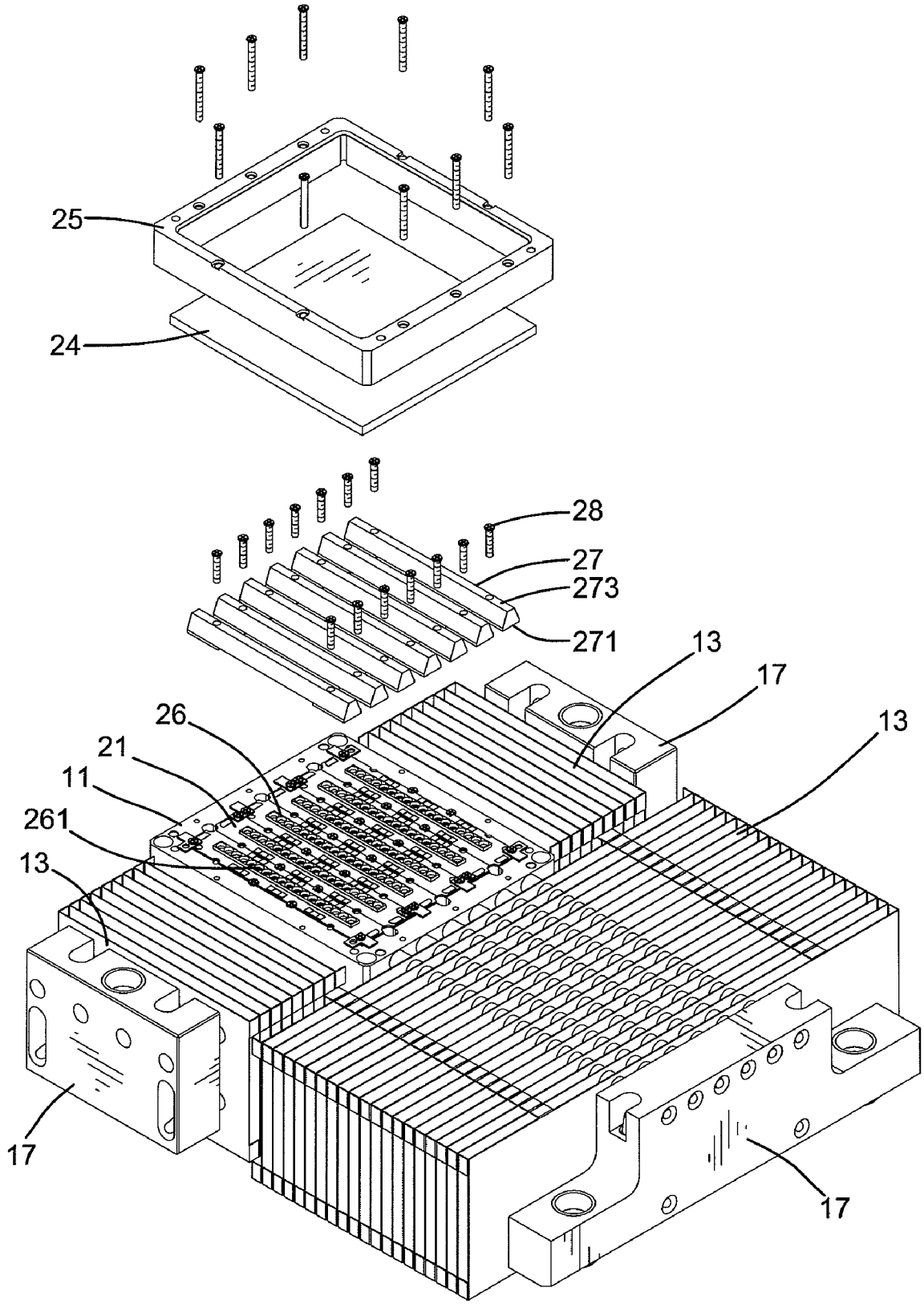
FIG. 14 shows another exploded, perspective view of the light-emitting diode module of FIG. 11.
Figure 15:
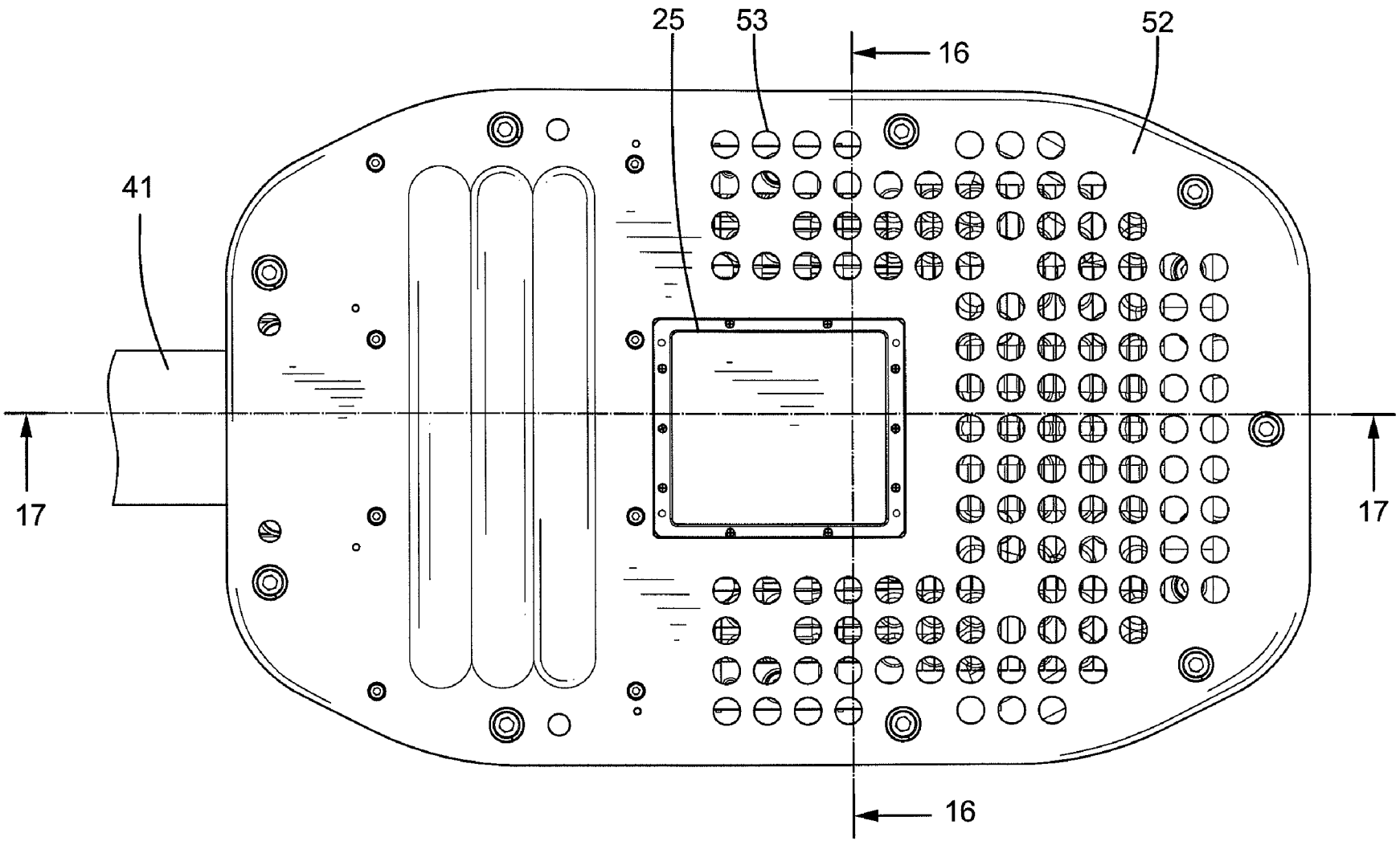
FIG. 15 is a top view of the lamp and the lamp post of FIG. 11.

In the preferred form shown in FIGS. 11-17, heat dissipating module 1 includes a jacket 11, a plurality of first heat conduction pipes 12, a plurality of second heat conduction pipes 15, and three finned heat sinks 13 (FIG. 13). Jacket 11 includes a coupling surface 112 having a plurality of engaging holes 115, and a plurality of fasteners 3 is respectively extended through through-holes 213 of metal substrates 21 and into engaging holes 115 of jacket 11 to engage metal substrates 21 with jacket 11. Jacket 11 further includes a plurality of longitudinal holes 111 parallel to and spaced from one another and each having a longitudinal axis parallel to the longitudinal axes of light-emitting diodes 22. An inner periphery of each longitudinal hole 111 is closely adjacent to coupling surface 112 such that a spacing D ranging from 0 to 0.5 mm is defined therebetween (FIG. 16*a*). Furthermore, jacket 11 includes a plurality of transverse holes 118 parallel to and spaced from one another and each extending from a first side 119 of jacket 11 through a second side 119 of jacket 11 spaced from first side 119 in a direction perpendicular to the longitudinal axes of longitudinal holes 111.

Figure 16:
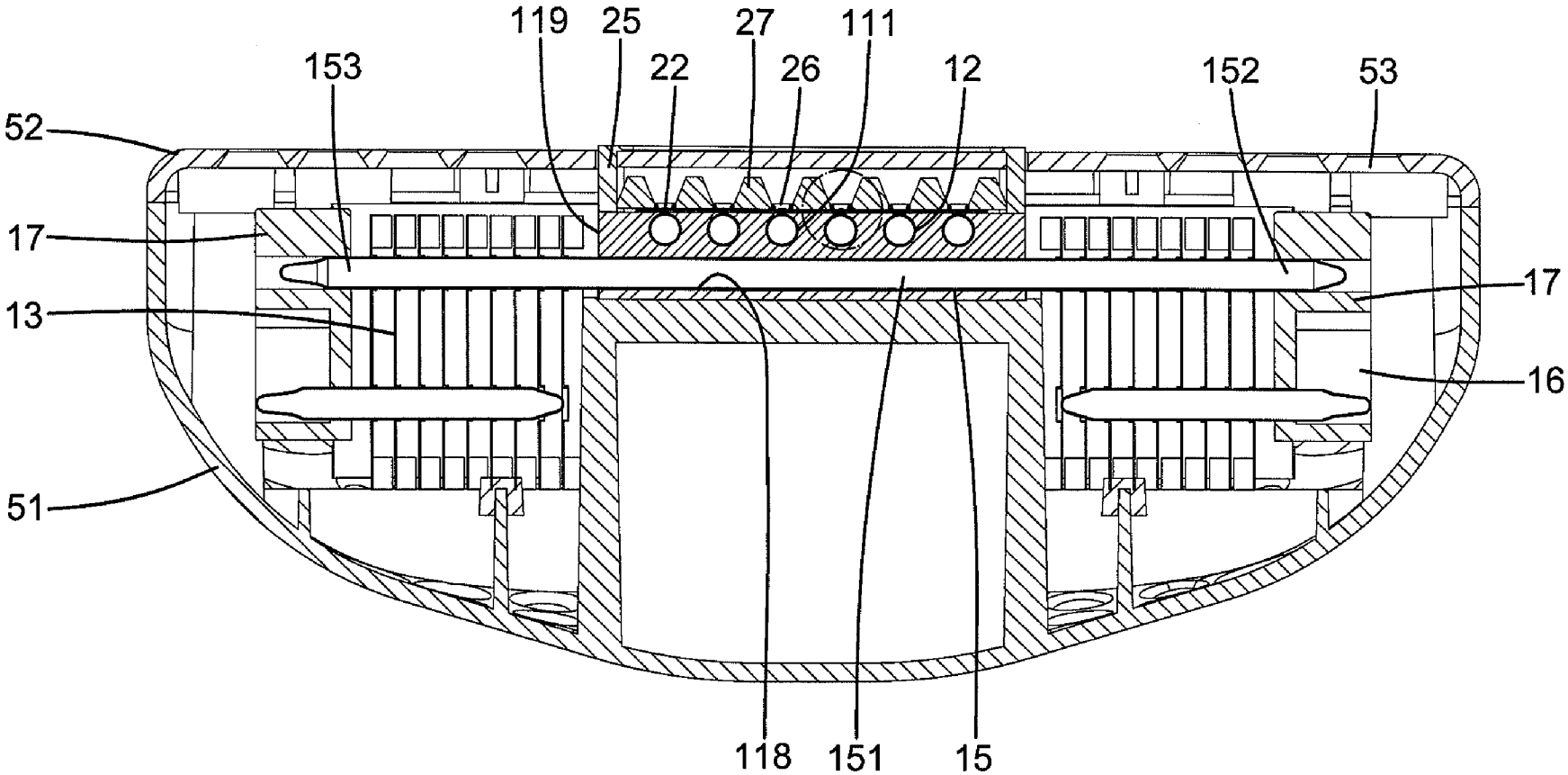
FIG. 16 is a cross sectional view taken along section line 16-16 of FIG. 15.
Figure 16A:
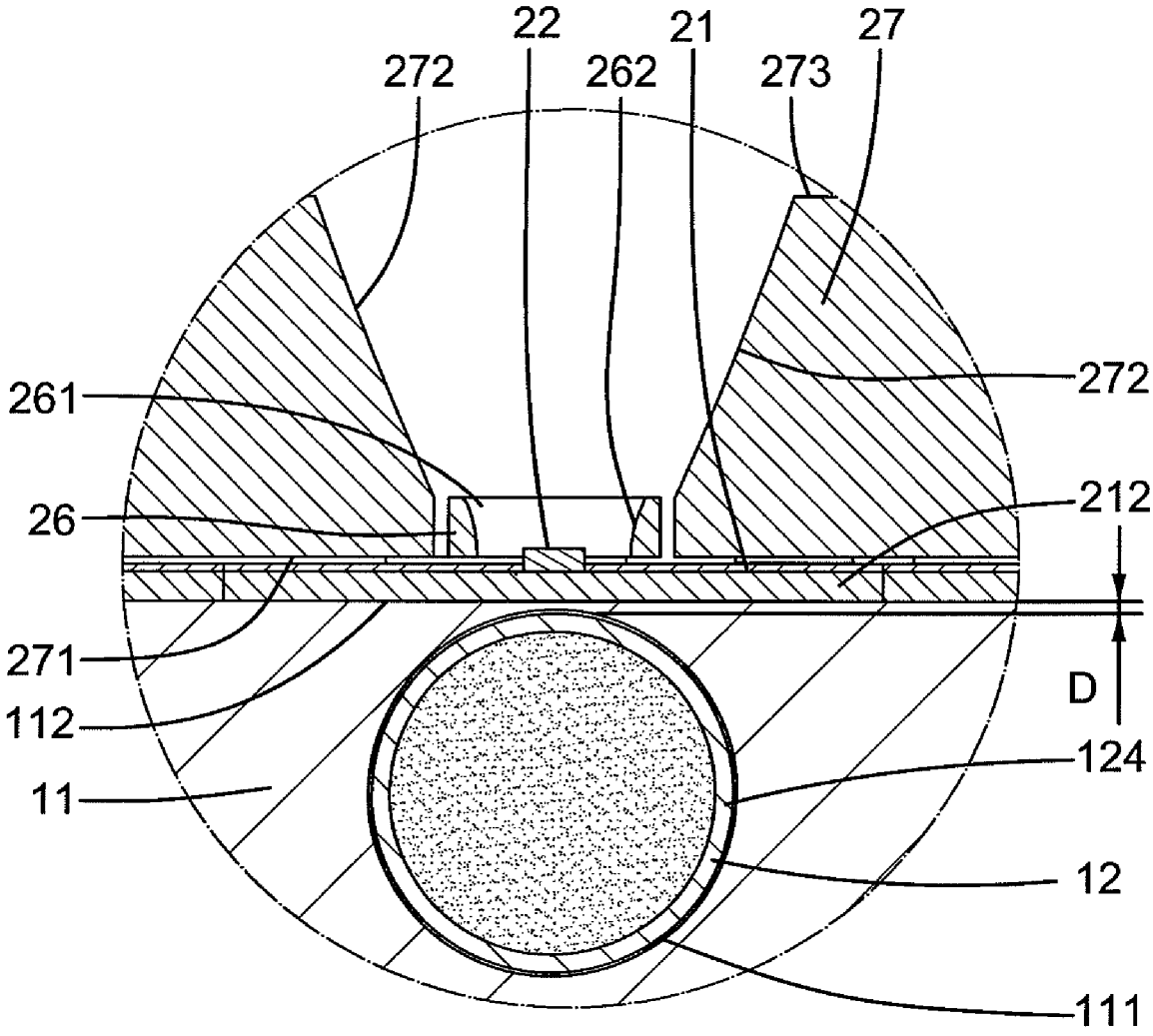
FIG. 16*a* shows an enlarged view of a circled portion of FIG. 16.
Figure 17:
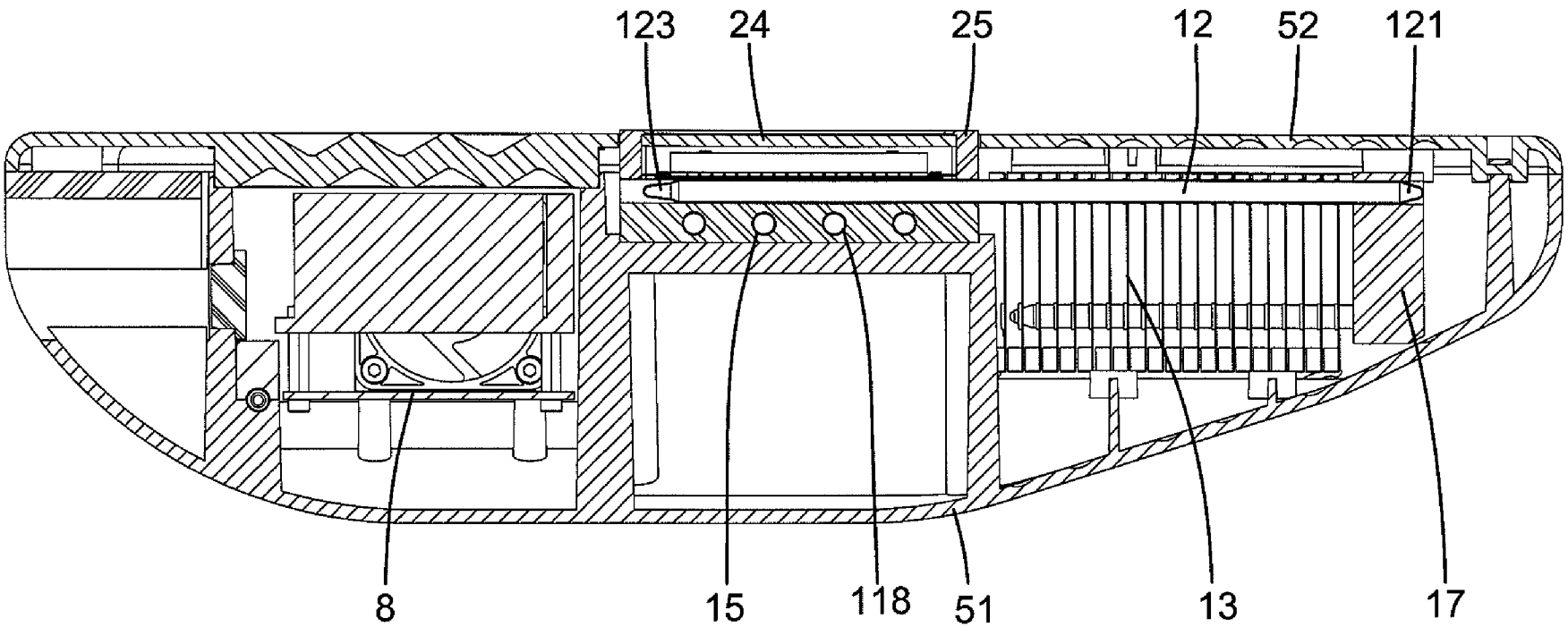
FIG. 17 is a cross sectional view taken along section line 17-17 of FIG. 15.

In the preferred form shown in FIGS. 11-17, each first heat conduction pipe 12 includes a first portion 123 received in one of longitudinal holes 111 of jacket 11 and a second portion 121 outside jacket 11 (FIG. 17). A portion of outer periphery 124 of first portion 123 of each first heat conduction pipe 12 is in proximity to second face 212 of metal substrate 21 to quickly absorb heat generated by light-emitting diode dies 221 (FIG. 16*a*). Each second heat conduction pipe 15 includes a first portion 151 received in one of transverse holes 118 of jacket 11, a second portion 152 outside jacket 11, and a third portion 153 outside jacket 11 (FIG. 16). Each finned heat sink 13 includes a plurality of fins 131 made of composite material including carbon fiber and metal material. Finned heat sinks 13 are respectively mounted on second portions 121 of first heat conduction pipes 12 and second and third portions 152 and 153 of second heat conduction pipes 15 to dissipate heat transferred to heat conduction pipes 12, 15 into the environment outside finned heat sinks 13. Further, each finned heat sink 13 has an outer end face 132 facing away from the jacket 11. A heat conduction block 17 is mounted on the outer end face 132 of each finned heat sink 13, allowing quicker dissipation of heat throughout the whole finned heat sink 13.

Figure 18:
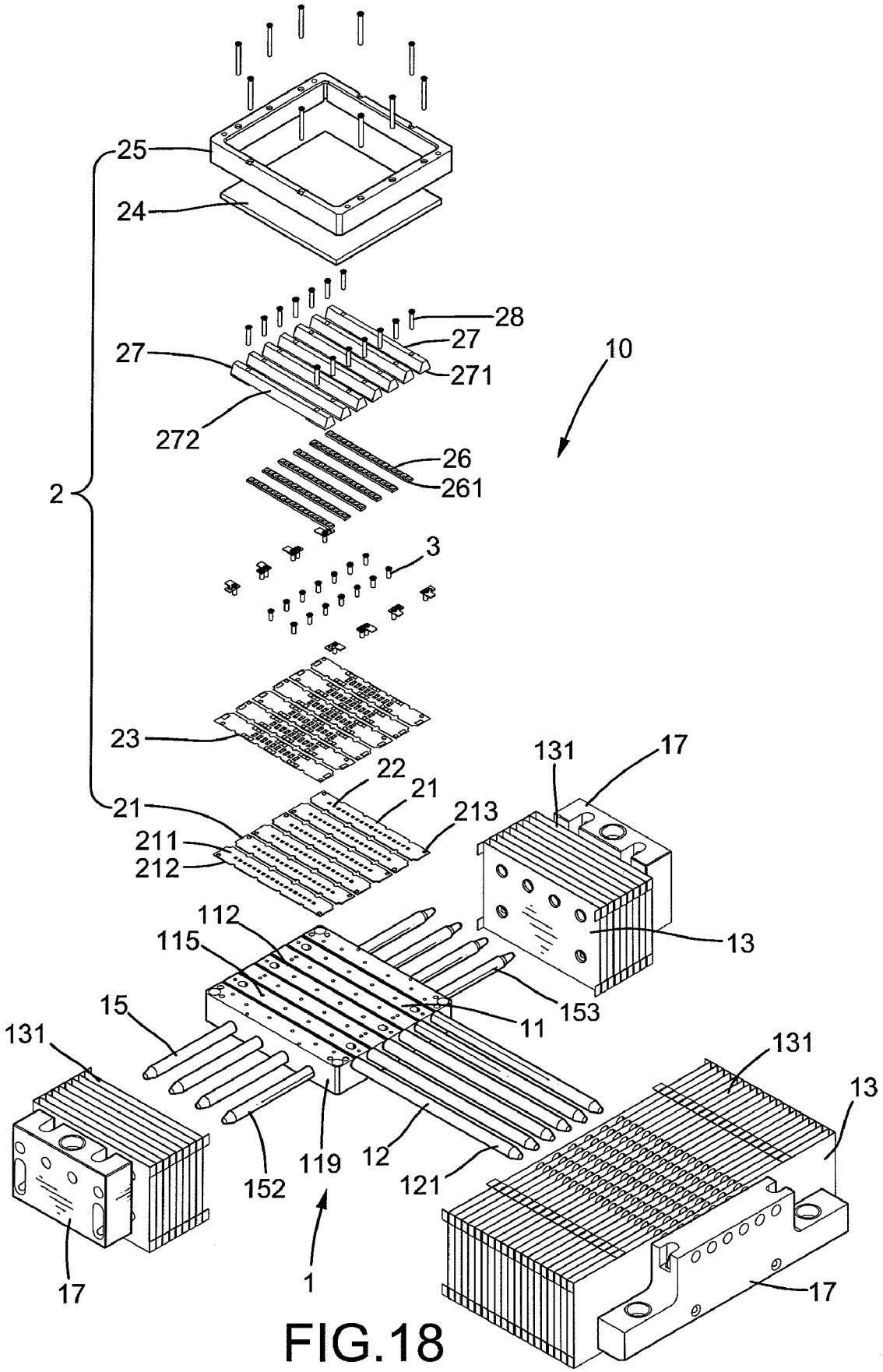
FIG. 18 shows an exploded, perspective view similar to FIG. 13, illustrating a modification of a jacket of the light-emitting diode module of FIG. 11.
Figure 19:
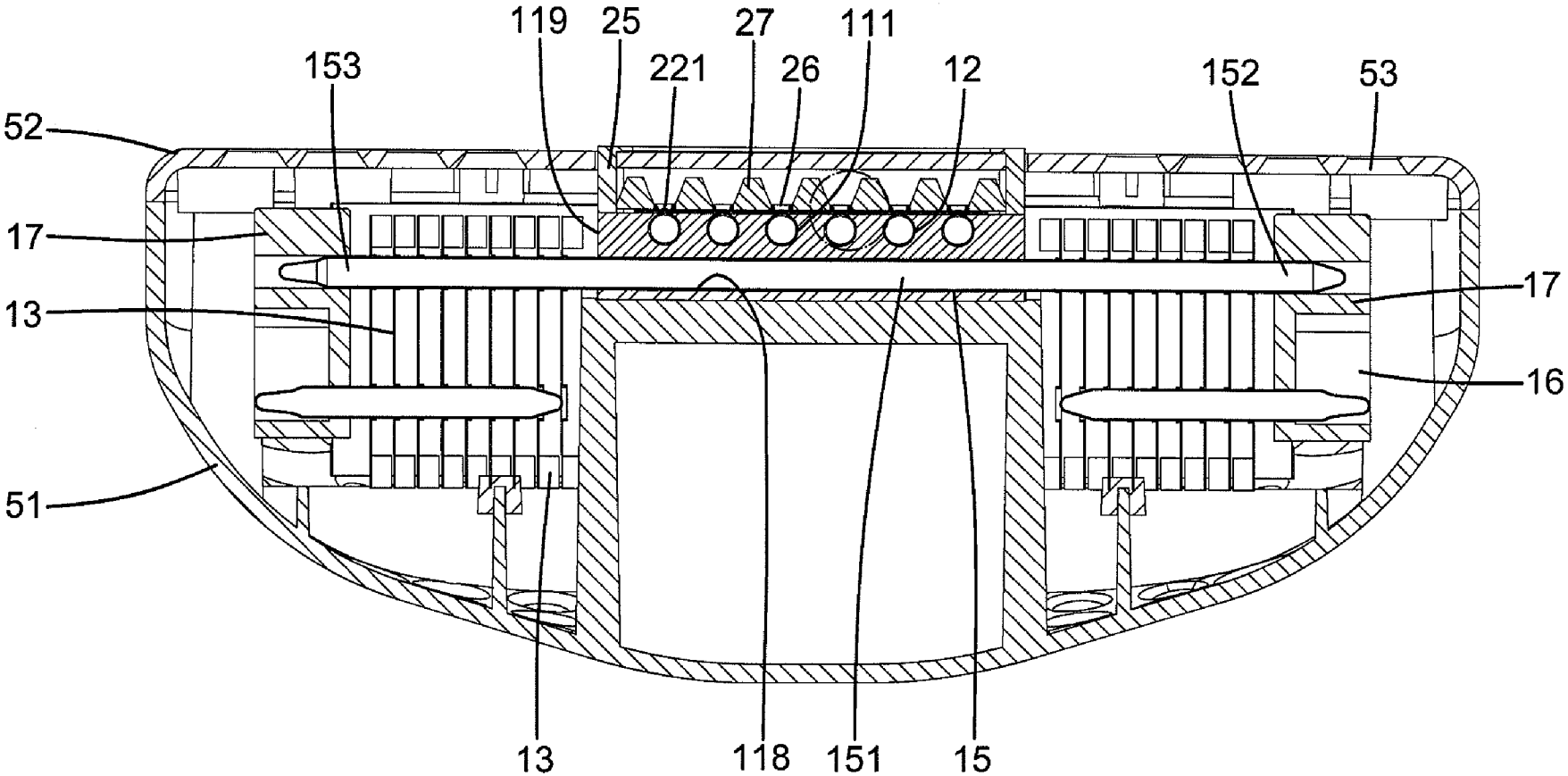
FIG. 19 is a cross sectional view similar to FIG. 16, illustrating the modification of the jacket of FIG. 18.
Figure 19A:
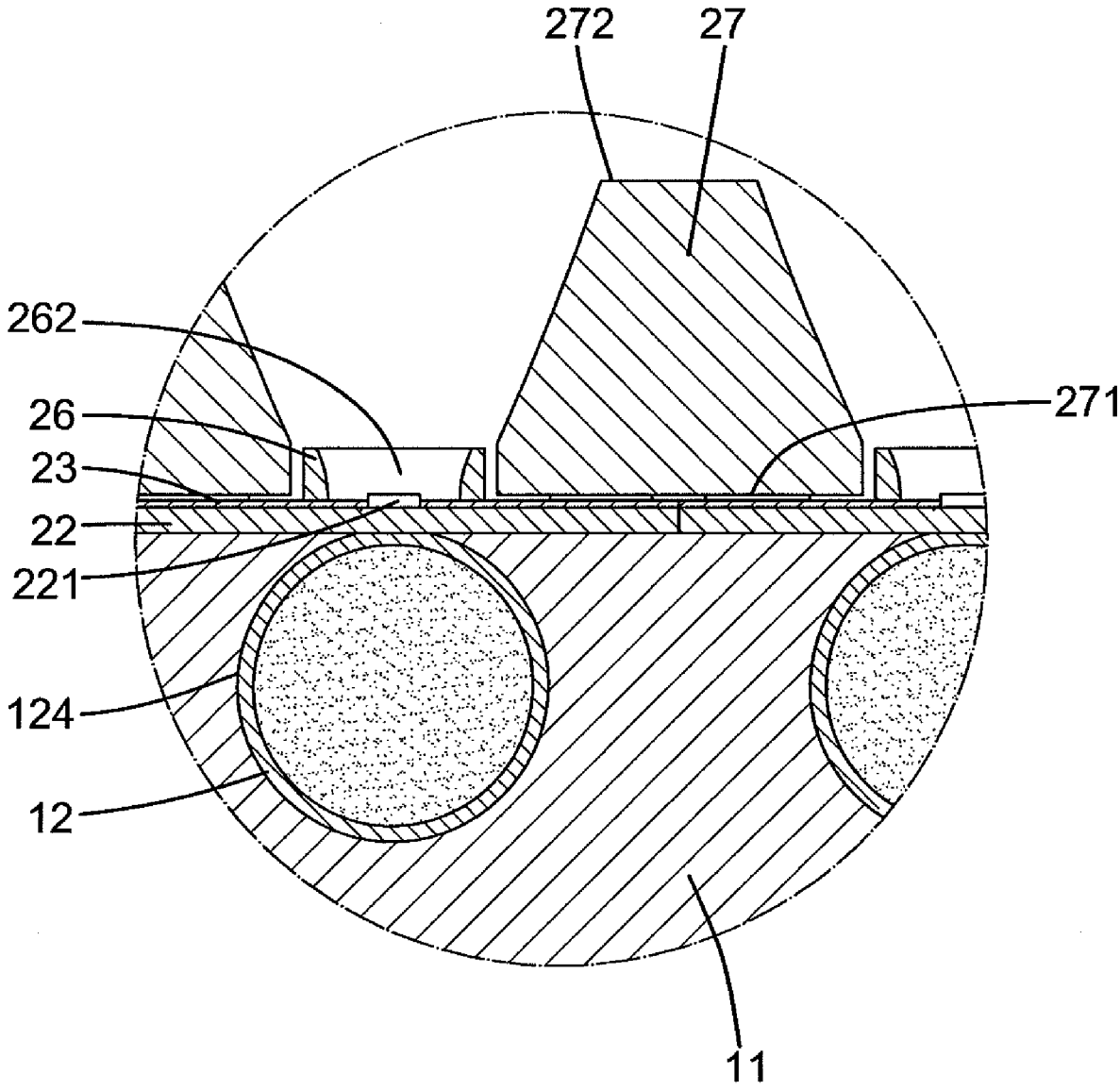
FIG. 19*a* shows an enlarged view of a circled portion of FIG. 19.

FIGS. 18 and 19 show a modification of jacket 11 of heat dissipating module 1 of lamp 6 in FIGS. 13 and 16. Coupling surface 112 of jacket 11 in this embodiment has a plurality of openings 114 extending in a direction parallel to the longitudinal axes of longitudinal holes 111. Each opening 114 extends in a plane tangent to and in communication with one of longitudinal holes 111 such that a portion of outer periphery 124 of first portion 123 of each first heat conduction pipe 12 is in direct, thermal contact with second face 212 of metal substrate 21 through one of openings 114 of jacket 11.

Namely, spacing D in FIG. 16*a* is reduced to 0 mm in this embodiment. Thus, the heat dissipating efficiency provided for LEDs 22 is increased.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A light-emitting diode module comprising, in combination:

a metal substrate having a first face and a second face opposite to the first face;

a plurality of light-emitting diodes mounted to the first face of the metal substrate and in direct, thermal contact with the metal substrate;

a jacket including a coupling surface engaged with the second face of the metal substrate, with the jacket further including a plurality of longitudinal holes parallel to and spaced from one another and each having a longitudinal axis, with a spacing ranging from 0 to 0.5 mm being defined between an inner periphery of each of the plurality of longitudinal holes and the coupling surface;

a plurality of first heat conduction pipes each including a first portion received in one of the longitudinal holes of the jacket and a second portion outside the jacket; and a finned heat sink mounted on the second portions of the plurality of first heat conduction pipes and including a plurality of fins to dissipate heat transferred to the first heat conduction pipes into an environment outside the finned heat sink.

2. The light-emitting diode module as claimed in claim 1, with the plurality of light-emitting diodes including a plurality of rows of light-emitting diodes parallel to and spaced from one another, with each of the plurality of rows of light-emitting diodes having a longitudinal axis parallel to the longitudinal axes of the longitudinal holes.

3. The light-emitting diode module as claimed in claim 2, with the coupling surface of the jacket having a plurality of openings each extending in a direction parallel to the longitudinal axes of the longitudinal holes, with each of the plurality of openings extending in a plane tangent to and in communication with one of the longitudinal holes, and with the first portion of each of the plurality of first heat conduction pipes having an outer periphery, with a portion of the outer periphery of the first portion of each of the plurality of first heat conduction pipes being in direct, thermal contact with the second face of the metal substrate through one of the plurality of openings of the jacket to absorb heat generated by the plurality of light-emitting diodes.

4. The light-emitting diode module as claimed in claim 2, further comprising, in combination: a plurality of light-concentrating sticks disposed on the first face of the metal substrate in a direction parallel to the longitudinal axes of the light-emitting diodes, with each of the plurality of light-concentrating stick covering one of the plurality of rows of light-emitting diodes and including a plurality of cylindrical light-concentrating holes each receiving one of the plurality of light-emitting diodes.

5. The light-emitting diode module as claimed in claim 4, with each of the plurality of light-concentrating holes including an outer end and an opening formed in the outer end, and with the opening including an enlarged conic periphery.

6. The light-emitting diode module as claimed in claim 2, further comprising, in combination: a plurality of light blocking walls disposed on the first face of the metal substrate in a direction parallel to the longitudinal axes of the light-emitting diodes, and with each of the plurality of light blocking walls intermediate two of the plurality of rows of light-emitting diodes adjacent to each other.

7. The light-emitting diode module as claimed in claim 6, with each of the plurality of light blocking walls including a lower face attached to the first face of the metal substrate, with each of the plurality of light blocking walls further including an upper face spaced from the lower face in a direction perpendicular to the longitudinal axes, and with each of the plurality of light blocking walls further including two inclined, opposite, lateral faces each extending between the upper face and the lower face and each tapering to the upper face.

8. The light-emitting diode module as claimed in claim 1, with the jacket further including first and second sides spaced from each other in a direction perpendicular to the longitudinal axes of the plurality of longitudinal holes, with the jacket having a plurality of transverse holes parallel to and spaced from one another and each extending from the first side of jacket through the second side of jacket, with the light-emitting diode module further comprising, in combination: a plurality of second heat conduction pipes each having a first portion received in one of the transverse holes of the jacket and a second portion outside the jacket; and a second finned heat sink mounted on the second portions of the second heat conduction pipes, and with each of the first and second finned heat sinks including a plurality of fins made of composite material including carbon fiber and metal material.

9. A lamp comprising, in combination:

a housing adapted to be mounted to a lamp post;

a metal substrate mounted in the housing and having a first face and a second face opposite to the first face;

a plurality of light-emitting diodes mounted to the first face of the metal substrate and in direct, thermal contact with the metal substrate;

a jacket including a coupling surface engaged with the second face of the metal substrate, with the jacket further including a plurality of longitudinal holes parallel to and spaced from one another and each having a longitudinal axis, with a spacing ranging from 0 to 0.5 mm being defined between an inner periphery of each of the plurality of longitudinal holes and the coupling surface;

a plurality of first heat conduction pipes each including a first portion received in one of the plurality of longitudinal holes of the jacket and a second portion outside the jacket; and a finned heat sink mounted on the second portions of the plurality of first heat conduction pipes and including a plurality of fins to dissipate heat transferred to the plurality of first heat conduction pipes into an environment outside the finned heat sink.

10. The lamp as claimed in claim 9, with the jacket further including first and second sides spaced from each other in a direction perpendicular to the longitudinal axes of the longitudinal holes, with the jacket having a plurality of transverse holes parallel to and spaced from one another and each extending from the first side of jacket through the second side of jacket, with the lamp further comprising, in combination: a plurality of second heat conduction pipes each having a first portion received in one of the plurality of transverse holes of the jacket and a second portion outside the jacket; and a second finned heat sink mounted on the second portions of the plurality of second heat conduction pipes.

11. The lamp as claimed in claim 9, with the coupling surface of the jacket having a plurality of openings each extending in a direction parallel to the longitudinal axes of the longitudinal holes, with each of the plurality of openings extending in a plane tangent to and in communication with one of the plurality of longitudinal holes, and with the first portion of each of the plurality of first heat conduction pipes having an outer periphery, with a portion of the outer periphery of the first portion of each of the plurality of first heat conduction pipes being in direct, thermal contact with the second face of the metal substrate through one of the plurality of openings of the jacket to absorb heat generated by the plurality of light-emitting diodes.

12. The lamp as claimed in claim 9, with the finned heat sink having an outer end face facing away from the jacket, and with the lamp further comprising: a heat conduction block mounted on the outer end face of the finned heat sink and coupled to the housing.

13. The lamp as claimed in claim 9, with the plurality of light-emitting diodes including a plurality of rows of light-emitting diodes parallel to and spaced from one another, with each of the plurality of rows of light-emitting diodes having a longitudinal axis parallel to the longitudinal axes of the longitudinal holes, with the lamp further comprising, in combination: a plurality of light-concentrating sticks disposed on the first face of the metal substrate in a direction parallel to the longitudinal axes of the light-emitting diodes, with each of the plurality of light-concentrating sticks covering one of the plurality of rows of light-emitting diodes and including a plurality of cylindrical light-concentrating holes each receiving one of the plurality of light-emitting diodes.

14. The lamp as claimed in claim 13, with the lamp further comprising, in combination: a plurality of light blocking walls disposed on the first face of the metal substrate in a direction parallel to the longitudinal axes of the light-emitting diodes, and with each of the plurality of light blocking walls intermediate two of the plurality of rows of light-emitting diodes adjacent to each other.

* * * * *